US009080266B2

(12) United States Patent
Debaes

(10) Patent No.: US 9,080,266 B2
(45) Date of Patent: Jul. 14, 2015

(54) METHOD FOR WEAVING A PILE FABRIC

(71) Applicant: NV MICHEL VAN DE WIELE, Kortrijk/Marke (BE)

(72) Inventor: Johny Debaes, Moorslede (BE)

(73) Assignee: NV MICHEL VAN DE WIELE, Kortriji/Marke (BE)

( * ) Notice: Subject to any disclaimer, the term of this patent is extended or adjusted under 35 U.S.C. 154(b) by 0 days.

(21) Appl. No.: 14/344,301

(22) PCT Filed: Sep. 19, 2012

(86) PCT No.: PCT/IB2012/001816
§ 371 (c)(1),
(2) Date: Mar. 11, 2014

(87) PCT Pub. No.: WO2013/041938
PCT Pub. Date: Mar. 28, 2013

(65) Prior Publication Data

US 2014/0338783 A1 Nov. 20, 2014

(30) Foreign Application Priority Data

Sep. 22, 2011 (BE) ..... 2011/0561
Oct. 13, 2011 (BE) ..... 2011/0600

(51) Int. Cl.

| | |
|---|---|
| ***D03D 27/10*** | (2006.01) |
| ***D03D 27/00*** | (2006.01) |
| ***D03D 27/16*** | (2006.01) |
| *D03D 23/00* | (2006.01) |

(52) U.S. Cl.
CPC ..... *D03D 27/10* (2013.01); *D03D 27/16* (2013.01); *D10B 2503/04* (2013.01)

(58) Field of Classification Search
CPC ..... D03D 27/10; D03D 39/16; D03D 39/18; D03D 39/20; D03D 27/00; D03D 27/02; D03D 27/06; D03D 39/00; B29K 2105/0845
See application file for complete search history.

(56) References Cited

U.S. PATENT DOCUMENTS

| | | | | |
|---|---|---|---|---|
| 4,404,999 | A * | 9/1983 | Woodall et al. | 139/391 |
| 4,756,340 | A * | 7/1988 | Janssen | 139/397 |
| 4,971,642 | A * | 11/1990 | Schwan | 156/85 |
| 5,398,730 | A * | 3/1995 | Derudder et al. | 139/21 |
| 5,400,831 | A * | 3/1995 | Gheysen | 139/21 |
| 5,655,573 | A * | 8/1997 | Gheysen et al. | 139/21 |

(Continued)

OTHER PUBLICATIONS

Written Opinion of the international search authority on WO 2013/041938 or PCT/IB2012/001816, Mar. 22, 2014.*

(Continued)

*Primary Examiner* — Bobby Muromoto, Jr.
(74) *Attorney, Agent, or Firm* — Symbus Law Group, LLC; Clifford D. Hyra

(57) ABSTRACT

A method for weaving a pile fabric on a weaving loom, in which successive positions of the ground warp threads (3-8) relative to the weft threads (1), (2) are determined according to a ground weave repeat which extends over at least eight weft introduction cycles, and in which pile tufts are formed, so that at least one pile fabric is obtained with weft threads (1), (2) which are bound in on at least two levels (I), (II), (III) and pile tufts which are bent over weft threads (2) which are not situated on the pile side, in which, per ground weave repeat, at least two different orientations (i), (ii), (iii) of the pile legs are achieved and/or two or more different pile densities are achieved.

13 Claims, 13 Drawing Sheets

(56) References Cited

U.S. PATENT DOCUMENTS

| | | | | |
|---|---|---|---|---|
| 6,092,562 | A * | 7/2000 | Debaes | 139/398 |
| 6,102,083 | A * | 8/2000 | Vandoorne | 139/391 |
| 6,182,708 | B1 * | 2/2001 | Smissaert | 139/21 |
| 6,289,941 | B1 * | 9/2001 | Debaes | 139/402 |
| 6,305,431 | B1 * | 10/2001 | Fenkes | 139/391 |
| 6,457,489 | B2 * | 10/2002 | Smissaert | 139/21 |
| 6,502,605 | B2 * | 1/2003 | Goessl et al. | 139/21 |
| 6,923,219 | B2 * | 8/2005 | Shteiyer | 139/397 |
| 7,395,839 | B2 * | 7/2008 | Debaes | 139/21 |
| 7,431,055 | B2 * | 10/2008 | Debaes et al. | 139/21 |
| 7,520,303 | B2 * | 4/2009 | Mertens et al. | 139/21 |
| 7,644,737 | B2 * | 1/2010 | Mueller | 139/21 |
| 8,385,587 | B2 * | 2/2013 | Debaes | 382/100 |
| 8,651,150 | B2 * | 2/2014 | Siebert | 139/21 |
| 2002/0006495 | A1 * | 1/2002 | Vinod | 428/89 |
| 2002/0189702 | A1 * | 12/2002 | Smissaert et al. | 139/418 |
| 2003/0056849 | A1 * | 3/2003 | Debaes et al. | 139/449 |

OTHER PUBLICATIONS

International Search Report dated Aug. 13, 2013.

* cited by examiner

METHOD FOR WEAVING A PILE FABRIC

This application claims the benefit of Belgian patent applications Nos. BE-2011/0561, filed Sep. 22, 2011, and BE-2011/0600 filed Oct. 13, 2011, which are hereby incorporated by reference in their entirety

FIELD OF THE INVENTION

The present invention relates to a method for weaving a pile fabric on a weaving loom, in which, in successive weft introduction cycles, weft threads are introduced between ground warp threads of a number of ground warp thread systems so that a base fabric is woven in which first weft threads are bound in on a first level situated on the pile side of the fabric and second weft threads are bound in on a level which is situated on the rear side relative to the first level, and in which pile warp threads form pile tufts over respective second weft threads.

BACKGROUND

According to such weaving methods, pile fabrics are woven in which a pattern or design is made visible on the pile side of the fabric by using pile yarns of different colours. Other known weaving methods introduce variety into the structure of the pile formation and make it possible, for example, to weave fabrics in which zones with cut pile are combined with zones with looped pile.

However, there is an increasing demand with modern interiors for pile fabrics with less striking variations. Pile fabrics with more plain variations can also be combined more readily with modern interiors.

SUMMARY

It is an object of the present invention to develop a weaving method for weaving such pile fabrics, in which it is possible to create an additional effect in a pile fabric in a more plain and subtle way, without using additional colour variation and without varying the structure of the pile formation.

This object is achieved by providing a method for weaving a pile fabric on a weaving loom, having the features of the first paragraph of this description, in which the successive positions of the ground warp threads relative to the weft threads are determined according to a ground weave repeat which extends over at least eight weft introduction cycles, in which groups of at least one weft thread are bound in in openings between a pair of binding warp threads of the same reed dent or of adjacent reed dents, between a first and a second crossing between said binding warp threads, in which at least one pile tuft is formed over at least one second weft thread of each group, in which the following applies to each pile tuft:

$A_1$=the number of first weft threads between the first crossing and the pile tuft, $A_2$=the number of second weft threads between the first crossing and the pile tuft, $B_1$=the number of first weft threads between the pile tuft and the second crossing, $B_2$=the number of second weft threads between the pile tuft and the second crossing, in which K1=the total number of first weft threads between the first and the second crossing and K2=the total number of second weft threads between the first and the second crossing in which K=K1−K2, and in which each of said numbers of $(A_1),(A_2),(B_1),(B_2)$ may be equal to 0, in which said positions are determined in such a manner that at least two orientations of a first (i), a second (ii) and a third orientation (iii) of the pile tuft legs are created within the same ground weave repeat, in which oblique orientations (i), (ii) of the pile tuft legs are obtained if at least one first weft thread and at least one second weft thread are provided for each group, in which i. the first orientation (i) is an oblique orientation which is obtained if
   $A_1+B_2$ is greater than $A_2+B_1$, or
   $B_1=0$ while $A_1\neq 0$, if K is an odd number;
ii. the second orientation (ii) is a differently directed oblique orientation which is obtained if
   $A_1+B_2$ is smaller than $A_2+B_1$, or
   $A_1=0$ while $B_1\neq 0$, if K is an odd number;
iii. the third orientation (iii) is a substantially vertical orientation which is obtained if $A_1+B_2$ is equal to $A_2+B_1$.

It is obvious that the weft threads which are situated outside the respective opening between crossing binding warp threads are not counted when determining the abovementioned numbers of first and second weft threads. Thus, the above definition refers to in each case the number of first and second weft threads of the respective group of weft threads which are bound in the same opening between a pair of binding warp threads.

According to another definition, it is also true that the first orientation (i) is an oblique orientation which is obtained by binding more first weft threads than second weft threads in the opening between the first crossing and the pile tuft, and not between the pile tuft and the second crossing, and/or by binding fewer first weft threads than second weft threads in the opening between the pile tuft and the second crossing and not between the pile tuft and the first crossing, the second orientation (ii), is a differently directed oblique orientation which is obtained by binding fewer first weft threads than second weft threads in the opening between the first crossing and the pile tuft and not between the pile tuft and the second crossing, and/or by binding more first weft threads than second weft threads in the opening between the pile tuft and the second crossing, and the third orientation (iii) is a substantially vertical orientation which is obtained by binding no weft threads in the opening between the first crossing and the pile tuft on the one hand and between the pile tuft and the second crossing on the other hand or by binding the same number of first weft threads on both sides of the pile tuft and the same number of second weft threads on both sides of the pile tuft in the opening.

In this patent application, the expression a number of weft threads "between the first crossing and the pile tuft" is understood to mean the number of weft threads which is situated between the crossing of the binding warp threads and that leg of the pile tuft which is closest to said crossing.

Analogously, the expression a number of weft threads "between the pile tuft and the second crossing" in this patent application is understood to mean the number of weft threads which is situated between that leg of the pile tuft which is closest to the crossing and the crossing of the binding warp threads.

In both these situations, weft threads which are situated between the pile legs are not counted. In said position, these weft threads also have no effect at all on the orientation of the pile legs.

However, where this patent application mentions "the total number of weft threads between two crossings", all weft threads are counted, also the weft threads which are situated between the pile legs.

By using relatively long ground weave repeats over at least eight weft introduction cycles, it is possible to create at least two different orientations of the pile legs for each repeat. As a result of these differences in orientation or shadow effects, the pile fabric obtains the desired variation which is much more subtle than is the case with colour variation and/or variation resulting from a change in pile structure.

In the method according to the present invention, a repeat over at least 8 weft introduction cycles is preferably used for the ground weaves. In a preferred method, the repeat extends over at least 12 weft introduction cycles, more preferably over at least 16 weft introduction cycles.

In a highly preferred method according to the present invention, a repeat for the ground weave is used over at least 24 weft introduction cycles. Most preferably, this repeat extends over at least 32 weft introduction cycles. In a particular application, a repeat is used which runs along the entire length of the fabric in the warp direction.

Such long ground weave repeats cannot be used on traditional weaving looms in which the ground warp threads are positioned by cam disc machines. With these machines, the ground weave repeat is usually limited to four or six weft introduction cycles. Longer repeats are required to create different orientations of the pile legs within the same repeat. To this end, at least one electronic dobby will for example be used or one or several servomotors will be used for each driven ground weaving frame and/or an individual control will be applied for positioning the ground warp threads.

These relatively long ground weave repeats also make it possible to successively use different pile weaves of different pile density within the same repeat. Thus, a 1/2-V-weave and a 1/4V-weave with a double pile density can be combined with one another in the same ground weave repeat. The zones of different pile density which have thus been obtained provide an additional plain variation to the appearance of the pile fabric, in which, in addition, a shadow effect is produced on the transition edge between zones of different pile density due to the fact that the yarn of the zone with the highest pile density will lean towards the zone of the lowest pile density, and due to the fact that the pile yarns in the zones of lower pile density will shrink back sooner than the pile yarns in the zones of higher pile density, for example as a result of certain finishing processes which are accompanied by supplying heat.

For example, when rinsing and drying or when applying a fixing layer, for example a latex layer, to the back of the pile fabric, the heat supplied will have a different effect on the zones of lower pile density. These will be able to shrink more freely, as they are not held up against the adjacent pile legs to such a degree.

The long ground weave repeats also make it possible to bind the weft threads in the base fabric at different levels. For example by binding these weft threads in above and below a tension warp thread. It is also possible to bind the non-pile-forming parts of pile warp threads (dead pile) into the base fabric in an extended state and to bind in weft threads at a different level by binding in these weft threads above and below said bound-in dead pile.

These first and second weft threads which are bound in at different levels are necessary to obtain obliquely oriented pile legs. By distributing the weft threads over two or more levels, it is also possible to achieve a higher pile density, due to the fact that the weft threads of different levels will start to move in such a manner that, in the finished pile fabric, they will be situated more or less above one another or in any case take up less space in the warp direction than would be the case if these weft threads were bound into the base fabric at the same level next to one another. This makes a higher pile density possible, as a result of which a variation can be accentuated more efficiently by a change in the pile density.

According to this method, it is possible, for example, to produce a pile fabric in which strip-shaped zones of different pile orientation alternate. In that case, the weaves for the different pile orientations are combined into a single large ground weave repeat. It is possible to select a continuously repeating pattern which, for example, extends over 20 to 400 weft introduction cycles, but it is also possible to provide an even longer ground weave repeat, even extending over the entire length of the pile fabric in the warp direction, so that it is possible to freely determine the width of each strip-shaped zone within this repeat and thus to vary the bandwidths of the different zones.

The method according to the present invention is preferably implemented in such a manner that the weft threads are bound into each base fabric on at least three different levels.

By for example providing more than one tension warp thread per base fabric, it is possible to distribute the weft threads over three or more levels. As a result of the above-described effect which causes the weft threads of each level to move towards one another until they are situated more or less above or below the weft threads of the other levels in the finished pile fabric, and by the fact that the weft threads are now distributed over three or more levels, it is possible to achieve still higher pile densities.

It is also possible to bind the non-pile-forming parts of pile warp threads (dead pile) in the base fabric in an extended state and to bind in weft threads at a different level by binding in these weft threads above and below this bound dead pile.

Preferably, the ground warp threads of each warp thread system comprise at least one binding warp thread and at least one tension warp thread, said openings are formed between two crossing binding warp threads, and the first and second weft threads are separated from each other by a tension warp thread, so that they are bound in at two different levels.

According to a particular method according to the present invention, it is provided that the ground warp threads of each warp thread system comprise a first and a second tension warp thread, so that the first weft threads are bound in on the pile side relative to the first tension warp thread, a first part of the second weft threads is bound in between the first and the second tension warp thread, and a second part of the second weft threads is bound in on the rear side of the second tension warp thread, so that the second weft threads are distributed over two different levels.

The advantages of binding in weft threads at three or more levels have already been indicated above.

According to a very preferred method according to the present invention, a face-to-face weaving method is used, in which two base fabrics are woven simultaneously, one above the other, in which pile warp threads are alternately bound in over a second weft thread of the upper base fabric and a second weft thread of the lower base fabric, and in which the pile warp threads between both base fabrics are cut so that two pile fabrics are obtained.

However, the method according to the present invention may also be used according to a single-piece weaving method, such as, inter alia, an Axminster weaving loom.

With a method according to the present invention, it is possible to bind in non-pile-forming parts of pile warp threads into a base fabric in an extended state or into one of both fabrics. This makes it possible to make pile warp threads of a different appearance (due to their colour, thickness, raw material, etc.) visible in the pile fabric according to a predetermined weaving pattern.

In a variant method according to the present invention, the first and second weft threads may be separated from each other by the non-pile-forming parts of pile warp threads which have been bound in in an extended state, so that said weft threads are bound in at two different levels.

In a preferred method, the pile warp threads form pile according to a 1/2V-weave.

The method according to the present invention may also be implemented in such a manner that, within the same ground weave repeat, first and second openings are formed in which pile is formed at a different pile density over second weft threads.

The relatively long ground weave repeats make it possible to use successively different pile weaves of different pile density within the same repeat. Thus, a 1/2-V-pile weave and a 1/4V-pile weave (of half the pile density) can be combined with each other within the same ground weave repeat. Due to the fact that the weft threads are distributed over two or more levels, a higher pile density can be obtained.

Due to the relatively long ground weave repeats, it is also possible to cross the ground warp threads less frequently in the base fabric. Thus, more weft threads are bound in the same opening together, and the weft threads are held together more tightly, which accentuates the difference between a zone of high pile density and a zone of lower pile density more clearly.

Thus, variations in the pile density can be combined with variations in the orientation of pile legs (shadow effects). As indicated above, an additional shadow effect is obtained at the transition edge between a zone of high pile density and a zone of lower pile density by the fact that pile legs of the zone of highest pile density will lean towards the zone of lowest pile density.

By determining the positions of the ground warp threads relative to the weft threads in such a manner that a larger number of weft threads are bound in said first openings than in the second openings, and that pile is formed at a higher pile density over the weft threads of the first openings than over the weft threads of the second openings.

By crossing the ground warp threads in certain zones less frequently, more weft threads are bound in together in the same opening than in other zones. In the former zones, the weft threads in first openings are held together more tightly than in the latter zones. As a result thereof, the difference between a zone of high pile density and a zone of lower pile density is more clearly visible. By crossing the ground warp threads in zones of lower pile density more frequently, it is furthermore ensured that the pile strength of the pile tufts in said zones is improved, while the pile legs are also held vertically more efficiently.

By not allowing a weft introduction means of the weaving loom to introduce weft thread during a number of weft introduction cycles, resulting in at least one first weft thread being omitted in the first openings, it is possible to further increase the pile density, as a result of which the difference with zones of lower pile density can be accentuated still further.

According to a preferred method according to the present invention, within the same ground weave repeat, first openings are formed with second weft threads (2) over which pile is formed according to a 1/2-V-weave, and second openings are formed with second weft threads (2) over which pile is formed according to a 1/4-V-weave.

Preferably, this method is used in such a manner that the number of first weft threads in each fabric equals the number of second weft threads.

With the method according to the present invention, a typical weft thread density would be 9 weft threads/cm, i.e. 4.5 pile rows/cm in a 1/2-V-weave. A fixed yarn, such as a PP-Heatset or Heatset Acryl is in this case more interesting as a pile yarn, as a desired orientation of the pile legs is more clearly visible if the yarn itself also has a more compact shape which results in a clearer pile tip and pile direction. However, it is also possible to use PP-BCF, the changes in direction also result in small differences in height which still manifest with BCF.

Other options are W-pile weaves, but these mean that more weft threads will have to be laid per cm and that the ground weaves will have to be adapted thereto.

This can also be combined with local omission of pile at the location where the pile orientation changes, so that this variation is accentuated even more.

BRIEF DESCRIPTION OF THE DRAWINGS

The invention will now be explained in more detail by means of the following more detailed description of a number of methods according to the present invention. These methods are only examples and can therefore by no means be regarded as a limitation of the scope of protection, nor of the area of application of the invention.

In this detailed description, reference numerals are used to refer to the attached figures, which in each case represent one or two diagrammatic cross sections along the warp direction of a face-to-face pile fabric, woven according to the method of the present invention, in which the warp threads of a reed dent are illustrated on each cross section, in which.

Figure 5:
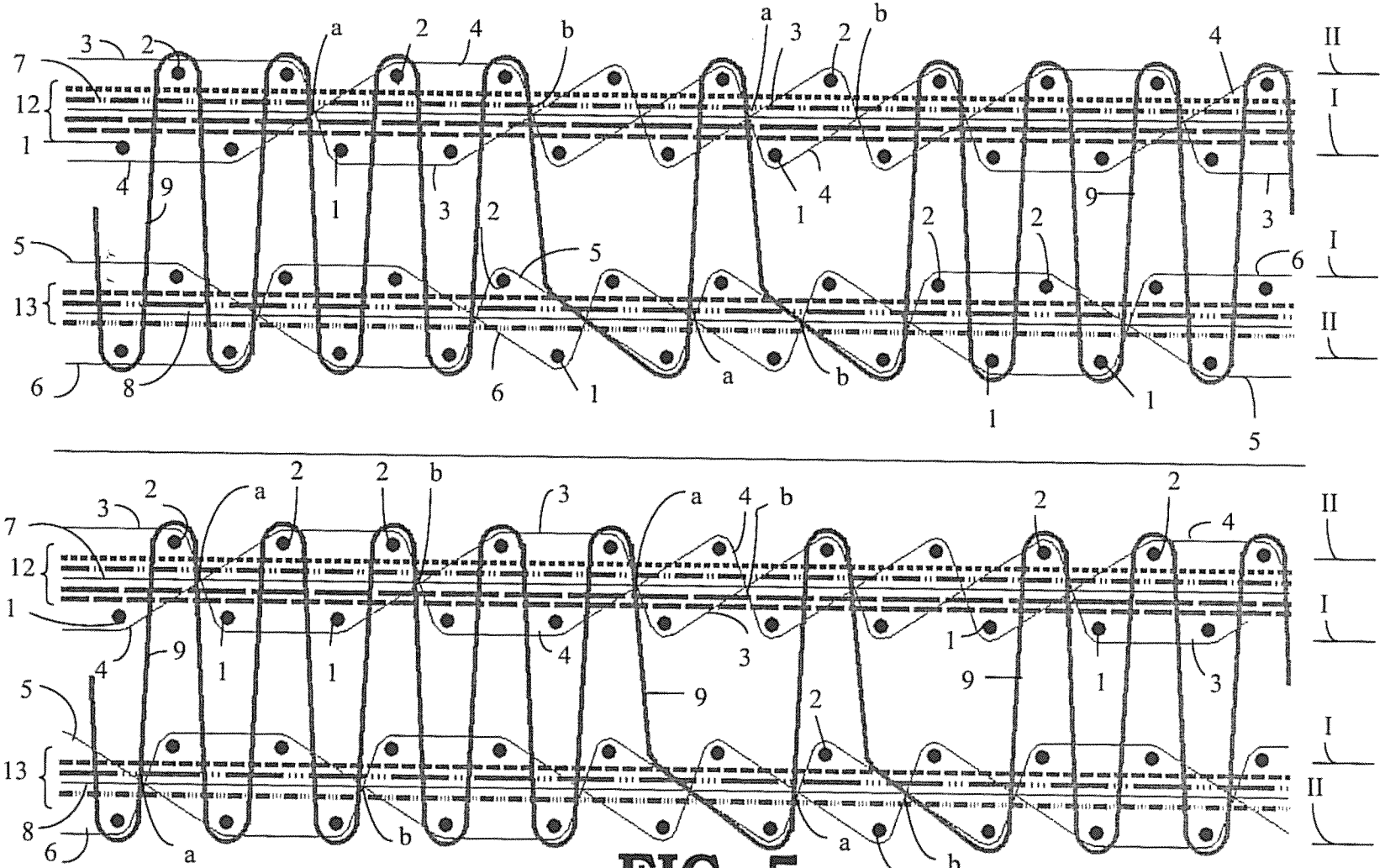
Figure 6:
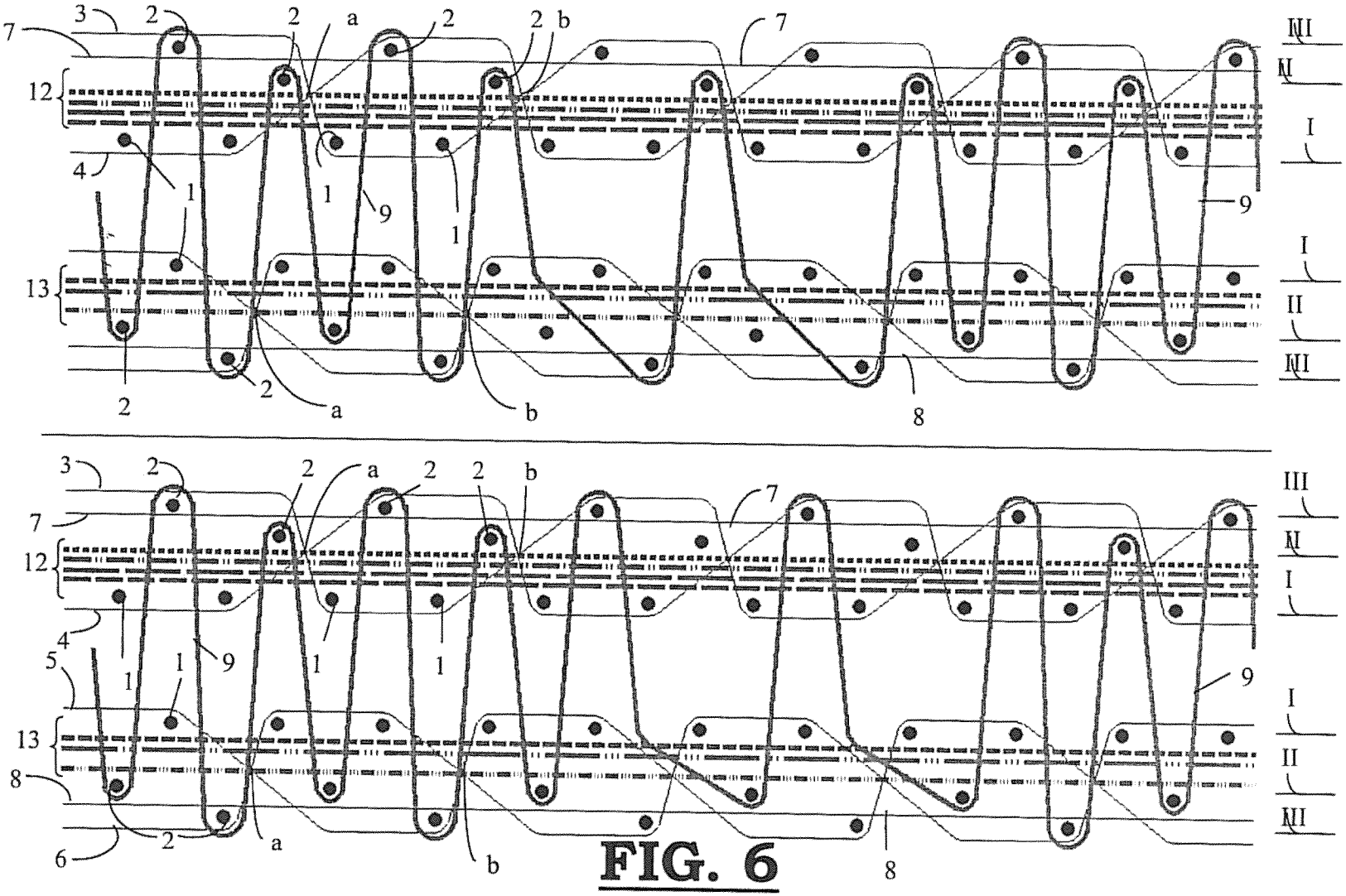
Figure 7:
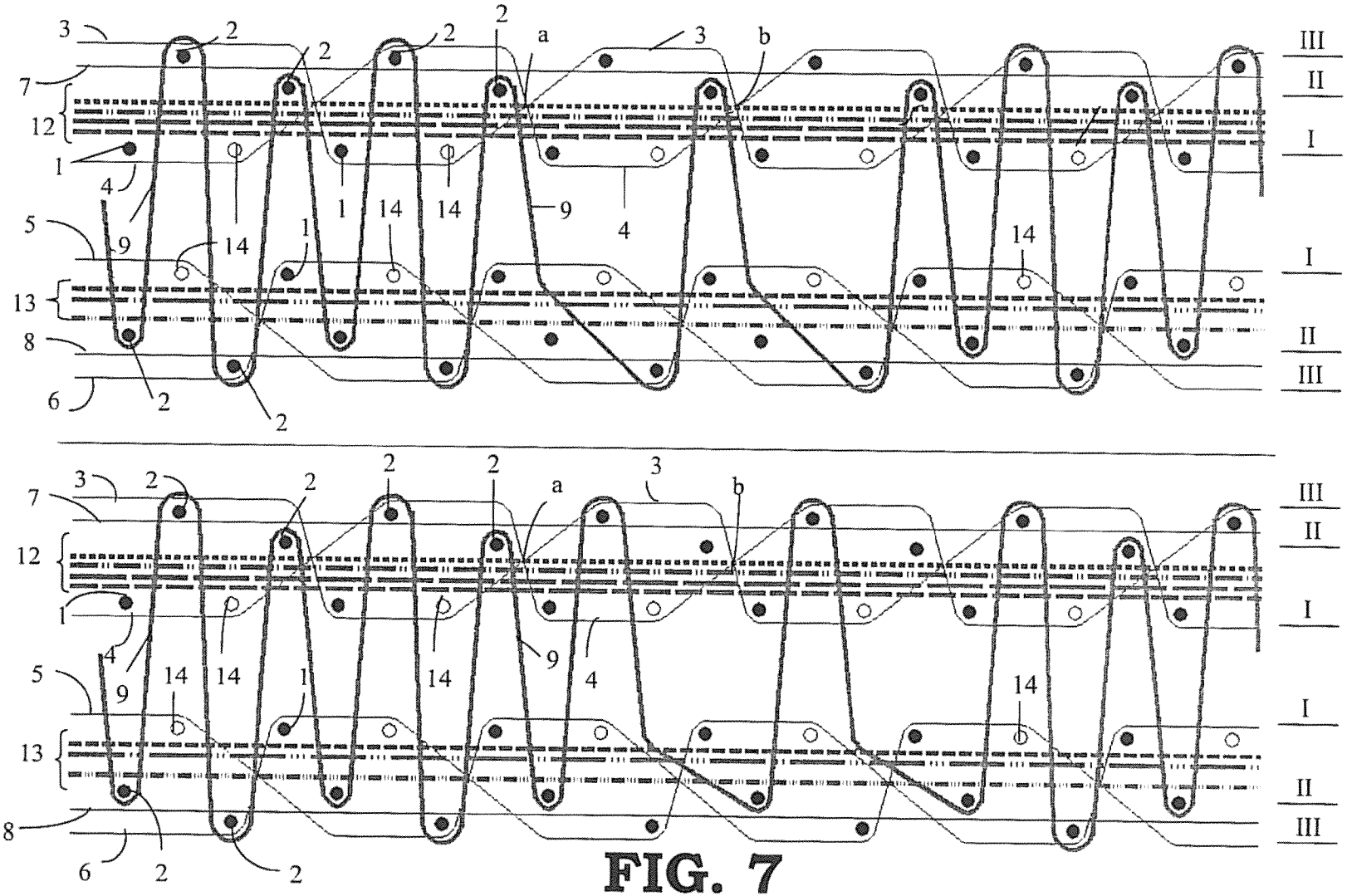
Figure 10:
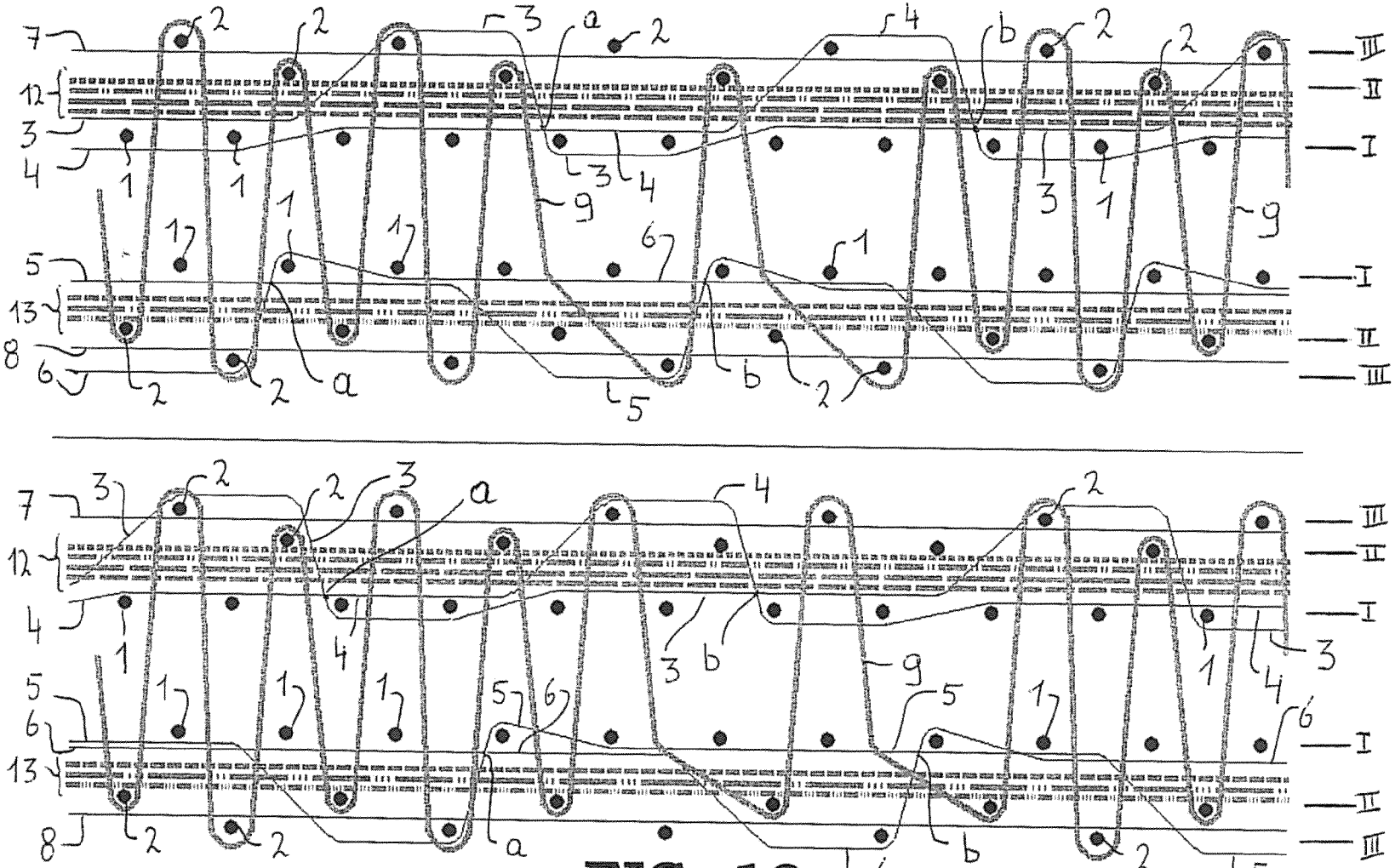
Figure 11:
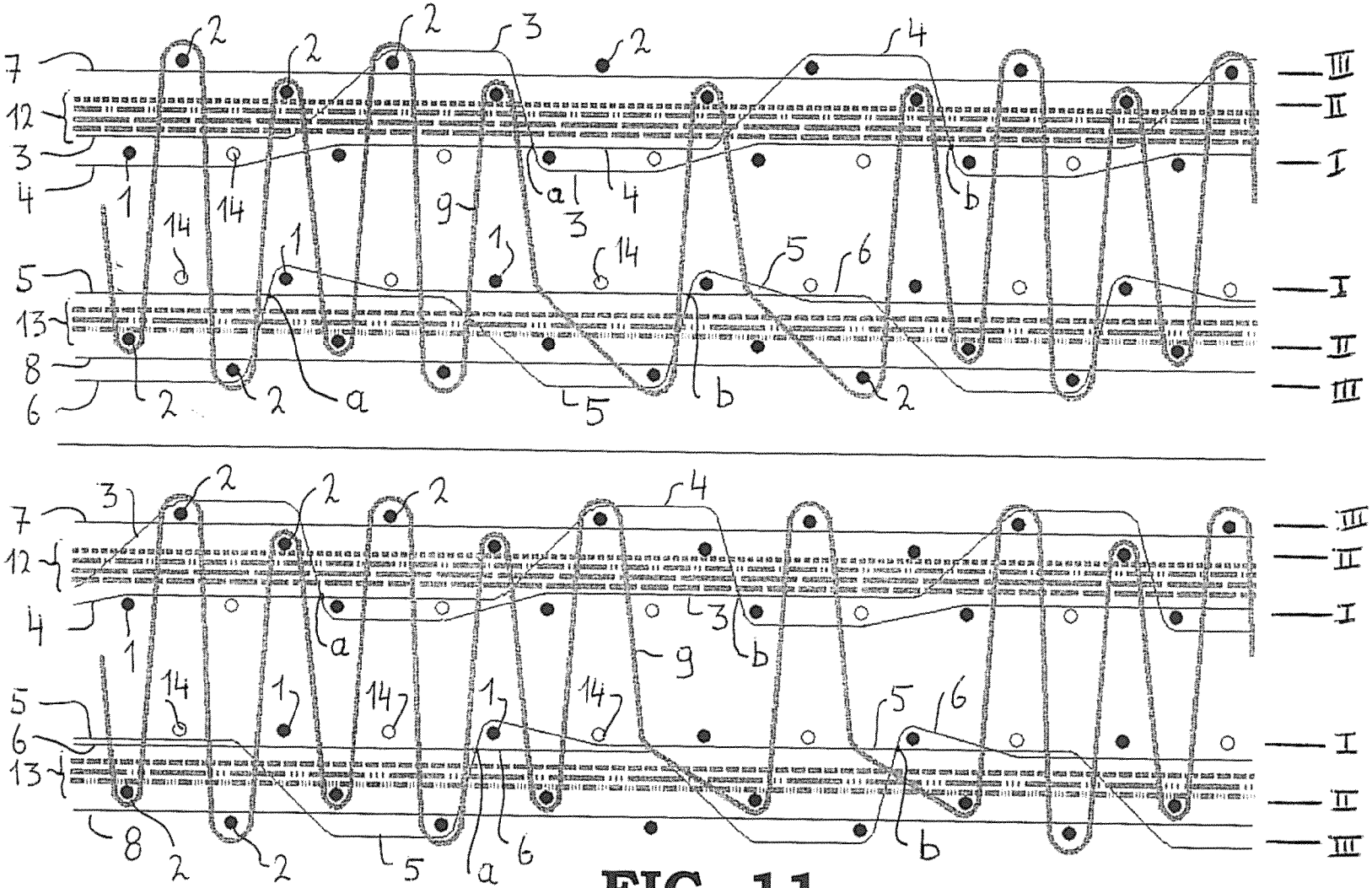
Figure 12:
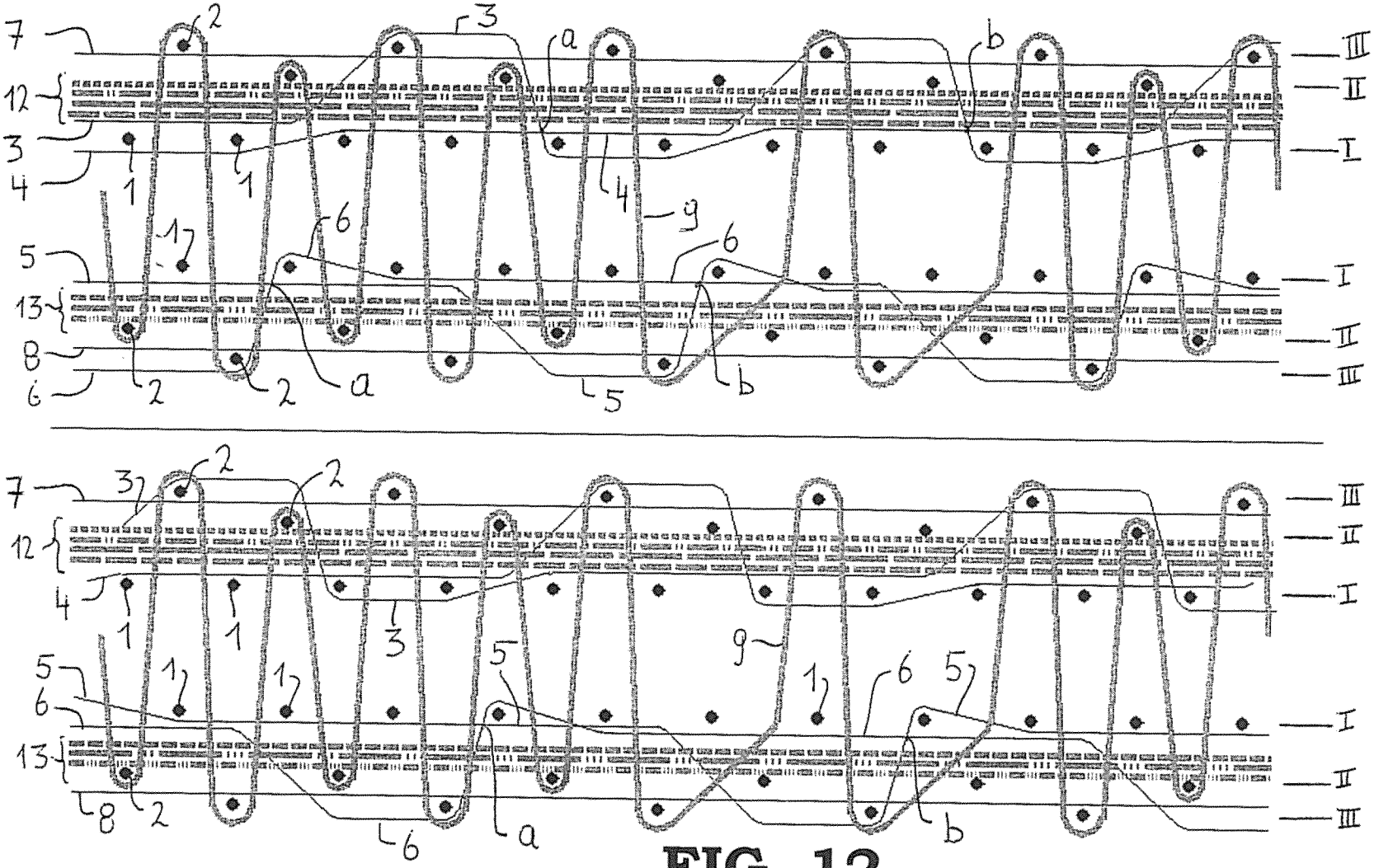
Figure 13:
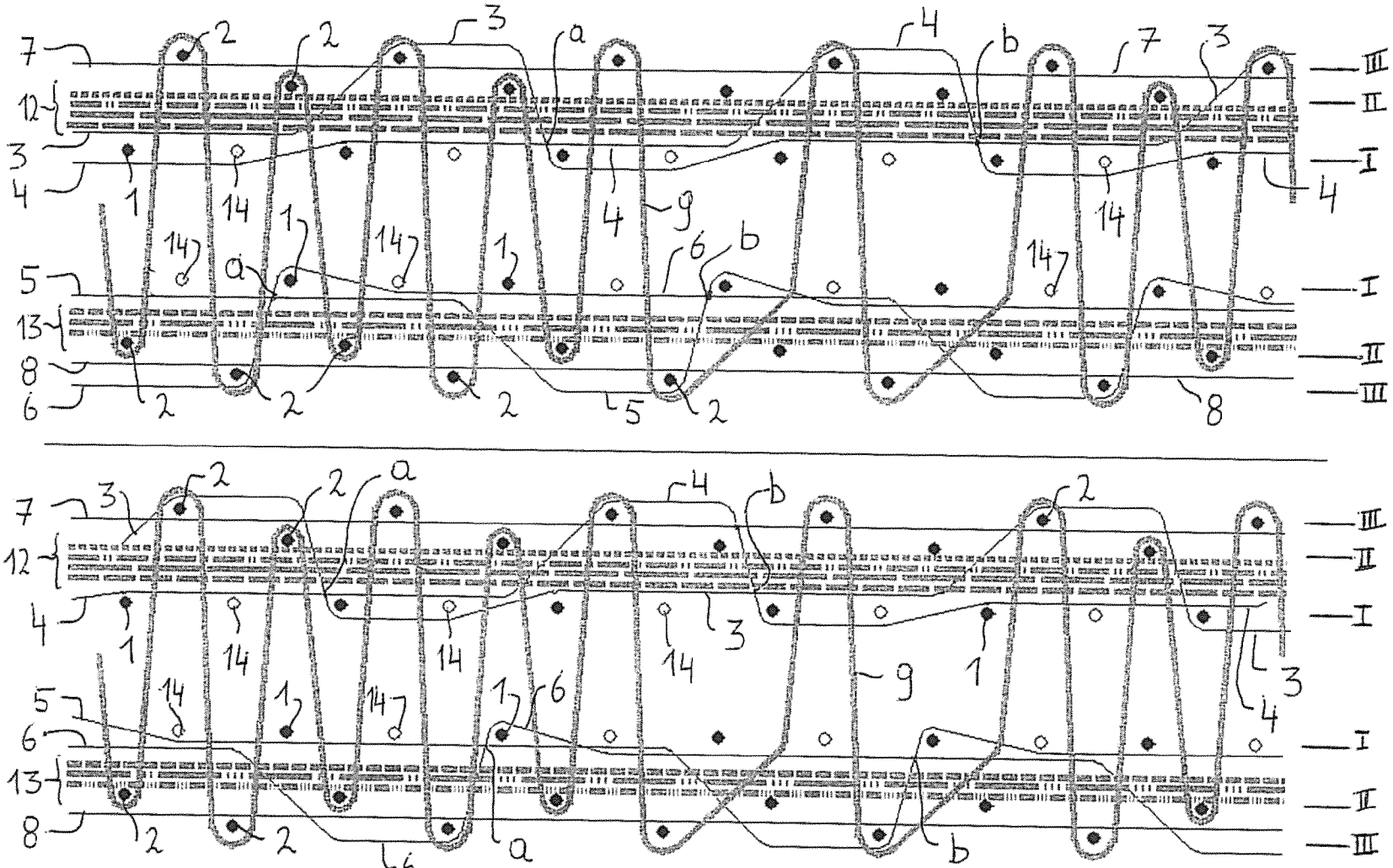

and in which the FIGS. 5 to 7 and 10 to 13 in each case show, in two diagrammatic cross sections, the warp threads of two adjacent reed dents of a face-to-face fabric which produces two pile fabrics with zones of different pile density, in which:

FIG. 5 shows a face-to-face fabric with bound-in dead pile warp threads and weft threads which are bound into the base fabrics at two different levels;

FIGS. 6 and 7 show a face-to-face fabric with bound-in dead pile warp threads and weft threads which are bound into the base fabrics at three different levels, in which FIG. 7 only differs from FIG. 6 in that weft threads have been omitted from the face-to-face fabric of FIG. 7;

FIGS. 10 and 11 show a face-to-face fabric with bound-in dead pile warp threads, weft threads which are bound into the base fabrics at three different levels, and a ground weave repeat over 16 weft introduction cycles, in which FIG. 11 only differs from FIG. 10 in that weft threads have been omitted from the face-to-face fabric of FIG. 11;

FIGS. 12 and 13 show a face-to-face fabric with bound-in dead pile warp threads, weft threads which are bound into the base fabrics at three different levels, and a ground weave repeat over 16 weft introduction cycles, in which FIG. 13 only differs from FIG. 12 in that weft threads have been omitted from the face-to-face fabric of FIG. 13.

DETAILED DESCRIPTION OF EMBODIMENTS

Figure 1:
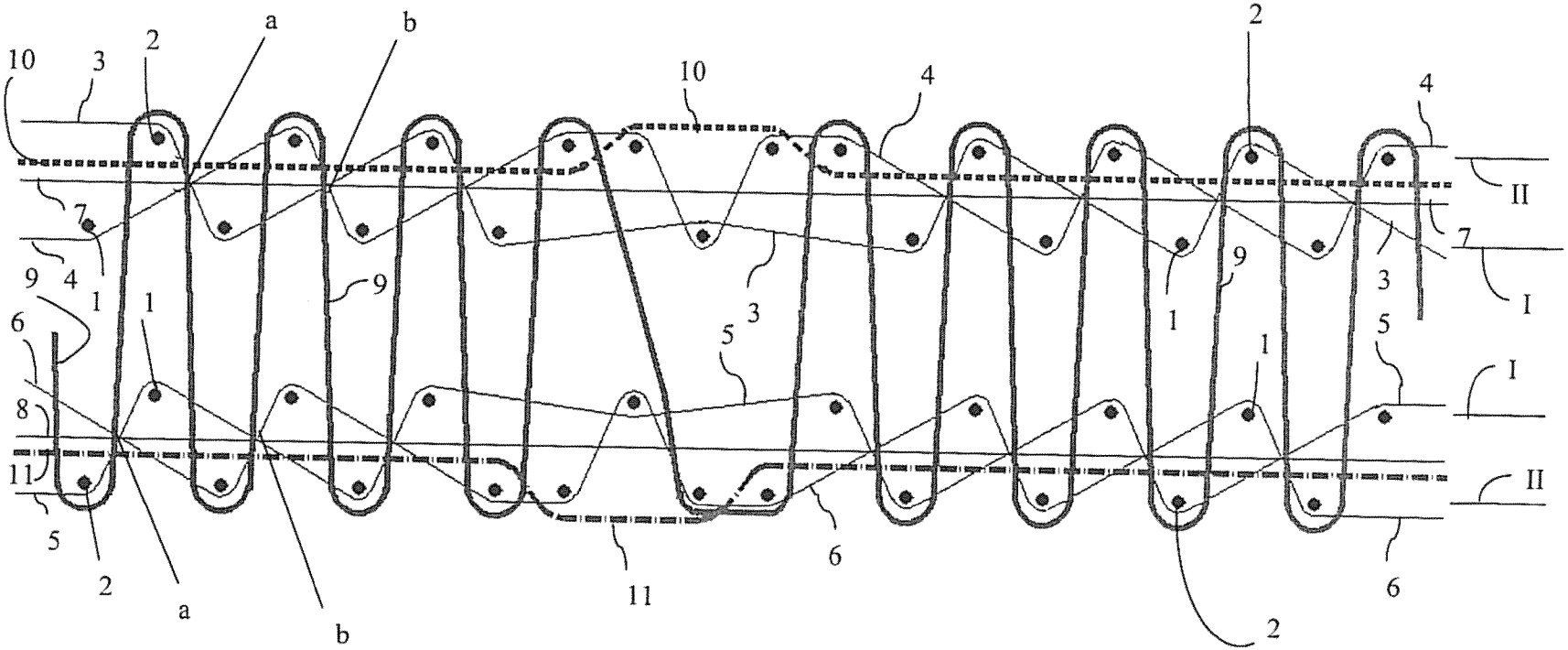
FIG. 1 shows a diagrammatic cross section of a face-to-face fabric which produces two pile fabrics with oriented pile.

FIG. 1 shows a face-to-face fabric which is woven by introducing in each case two weft threads (1), (2) one above the other in successive weft introduction cycles at an upper and a lower weft thread insertion level, in a shed between binding warp threads (3-6), tension warp threads (7, 8) and pile warp threads (9-11). In the diagrammatic cross sections illustrated in FIGS. 1 and 2, only the warp threads (3-11) of one reed dent are shown.

In this case, the ground warp threads (3-8) are positioned relative to the two weft thread insertion levels in the successive weft introduction cycles in such a way that an upper base fabric is formed in which weft threads (1), (2) are bound in at two levels (I), (II), above and below the tension warp threads (7), in openings between binding warp threads (3), (4) which repeatedly cross one another, and so that a lower base fabric is produced in which weft threads (1), (2) are bound in at two levels (I), (II), above and below the tension warp threads (8), between binding warp threads (5), (6) which repeatedly cross one another. The ground weave used is 1/1 for the tension warp threads (7); (8) and 2/2 for the binding warp threads (3),(4); (5),(6). The tension warp threads (7); (8) ensure that the weft threads are bound in at two different levels. This is achieved by applying a greater tension to the tension warp threads than to the binding warp threads. As a result thereof, this tension warp thread will extend more or less straight in the pile fabric.

During this weaving procedure, the pile warp threads (9-11) in the successive weft introduction cycles are positioned relative to the two weft thread insertion levels in such a manner that one of the pile warp threads (9) is interlaced with a weft thread (2) of the second level (II) alternately in the upper and the lower base fabric. The pile weave used is a 1/2V-weave. The pile-forming pile warp threads (9) between both fabrics are subsequently cut so that two pile fabrics are obtained with pile tufts which are bent over a weft thread (2) in a U shape.

In the part of the face-to-face fabric shown in FIG. 1, two pile warp threads (10), (11) do not form pile. The one pile warp thread (10) which does not form pile is bound into the upper base fabric in an extended state, together with the tension warp threads (7). The other pile warp thread (11) which does not form pile is bound into the lower base fabric in an extended state, together with the tension warp threads (8).

The weft threads (1) which are bound into the base fabrics at the first level (I) situated on the pile side are referred to as first weft threads (1). The weft threads (2) which are bound in at another level which is situated on the rear side relative to this first level are referred to as second weft threads (2). The second weft threads (2) in the fabrics according to the FIGS. 1 to 5 are in each case situated at the same second level (II). However, the second weft threads (2) may also be distributed over several levels. This is the case with the fabrics according to FIGS. 6 to 13 where the second weft threads are distributed over a second (II) and a third level (III).

The successive positions of the ground warp threads (3-8) relative to the weft threads (1), (2) are determined according to a ground weave repeat which extends over at least eight weft introduction cycles. Locally, a ground weave repeat of less than 8 weft introduction cycles may occur, but this is then followed by another ground weave repeat, so that the ground weave repeat eventually becomes much greater than 8.

The ground weave of FIG. 1 is such that a zone is obtained on the left-hand side in the upper and the lower pile fabric in which the legs of the pile tufts lean to the right and on the right-hand side a zone is obtained in which the legs of the pile tufts lean to the left. A more detailed description will be given below of the manner in which these different pile orientations are achieved in both zones, with both the upper and the lower base fabric being discussed.

The left-Hand Zone of the Pile Fabrics from FIG. 1:

In a left-hand zone of the fabric, groups of two weft threads (1), (2) are bound in openings between binding warp threads (3),(4); (5),(6) which cross each other. Each opening is situated between a first crossing (a) and a second crossing (b) between these binding warp threads (3), (4); (5), (6). In this case, it is assumed there is a sequence from the left to the right, so that the first crossing (a) between which an opening is formed is in each case that crossing which is furthest to the left in the figures. In this case, each opening of the upper base fabric successively contains a first weft thread (1) and a second weft thread (2). Each opening of the lower base fabric is successively provided with a first weft thread (1) and a second weft thread (2). For each opening in this zone, a pile tuft is formed over in each case one second weft thread (2).

a. Pile Orientation in the Upper Pile Fabric:

For pile tufts of the left-hand zone in the upper pile fabric, the total number of (K1) first weft threads (1) between the first (a) and second (b) crossing=1, and the total number of (K2) second weft threads (2) between the first (a) and second (b) crossing=1, and the number of (A1) first weft threads (1) between the first crossing (a) and the pile tuft equals 1, while the number of (A2) second weft threads (2) between the first crossing (a) and the pile tuft equals 0, and the number of (B1) first weft threads (1) between the pile tuft and the second crossing (b) equals 0, while the number of (B2) second weft threads between the pile tuft and the second crossing (b) equals 0.

The following therefore applies to each pile tuft of the upper pile fabric in the left-hand zone:

$A_1=1, B_1=0$ $A_2=0, B_2=0$ $K=K_1-K_2=0=\text{even}$

In this situation, an oblique position of the pile legs towards the right of the pile tuft in question is achieved.

There are no weft threads in the openings to the right of the first weft threads (1) at the first level (I), as the second weft threads (2) are situated at the second level (II) situated above. As a result thereof, the first weft threads (1) in each opening will be able to move to the right during the formation of the pile fabric and these will push the pile legs of the pile tuft into a slanting position leaning to the right.

b. Pile Orientation in the Lower Pile Fabric

In the lower pile fabric as weft, the total number of first weft threads $K_1$ between the first (a) and second (b) crossing=1, and the total number of second weft threads $K_2$ between the first (a) and second (b) crossing=1, and for each pile tuft between the first crossing (a) and the pile tuft, one first weft thread (1) and zero second weft threads (2) are bound in the opening, while between the pile tuft and the second crossing (b), zero first weft threads (1) and zero second weft threads (2) are bound in the opening, so that the following also applies to each pile tuft of the left-hand zone in the lower pile fabric:

$A_1$=1, B1=0

A2=0, B2=0

K=K1−K2=0=even

This also results in a slanting position of the pile legs which leans to the right. In this case as weft, the first weft threads (1) in each opening can move to the right during the formation of the pile fabric, as a result of which they push the pile legs of the pile tuft into a slanting position which leans to the right.

The Right-Hand Zone of the Pile Fabrics from FIG. 1:

In a right-hand zone of the fabric, groups of two weft threads (1),(2) are likewise bound in openings between binding warp threads (3),(4); (5),(6) which cross one another. In this case, a second weft thread (2) and a first weft thread (1) are successively present in each opening of the upper base fabric.

Compared to the left-hand zone, the sequence of first weft threads (1) and second weft threads (2) in each opening is thus reversed. In each opening of the lower base fabric, a second weft thread (1) and a first weft thread (2) are successively provided. The sequence of first weft threads (1) and second weft threads (2) in each opening is thus also reversed in the bottom fabric, compared to the left-hand zone. For each opening in said right-hand zone, a pile tuft is also formed over in each case one second weft thread (2).

a. Pile Orientation in the Upper Pile Fabric:

The following applies to the pile tufts of the right-hand zone in the upper pile fabric:

A1=0, B1=1

A2=0, B2=0

K=K1−K2=0 even

This results in a differently directed slanting position of the pile legs compared to the left-hand zone of the upper pile fabric, that is to say a slanting position of the pile legs which is directed to the left.

There are no weft threads in the openings to the left of the first weft threads (1) at the first level (I), since the second weft threads (2) are on the second level (II) situated above. As a result thereof, the first weft threads (1) in each opening will be able to move to the left during formation of the pile fabric and these will push the pile legs of the pile tuft into a slanting position which leans to the left.

b. Pile Orientation in the Lower Pile Fabric.

In the lower pile fabric, the following also applies to the pile tufts of the right-hand zone:

A1=0, B1=1

A2=0, B2=0

K=K1−K2=0 even

This results in a differently directed slanting position of the pile legs compared to the left-hand zone of the lower pile fabric, i.e. a slanting position of the pile legs which is directed to the left.

In this case as weft, the first weft threads (1) in each opening can move to the left during the formation of the pile fabric, as a result of which they push the pile legs of the pile tuft into a slanting position which leans to the left.

Each opening between ground warp threads is situated between two crossings of these ground warp threads. These crossings are referred to as the first (a) and the second crossing (b) in this patent application. A sequence in the figures is assumed to run from the left to the right. For the sake of clarity, it is pointed out that the second crossing (b) of a certain opening is obviously also the first crossing (a) of the subsequent opening. A certain crossing is referred to as a first (a) or second crossing (b), depending on whether the opening is situated downstream of this crossing or the opening is situated upstream of this crossing. The indications (a) and (b) in the figures only apply to the opening which is situated between this first (a) and second crossing (b).

Figure 2:
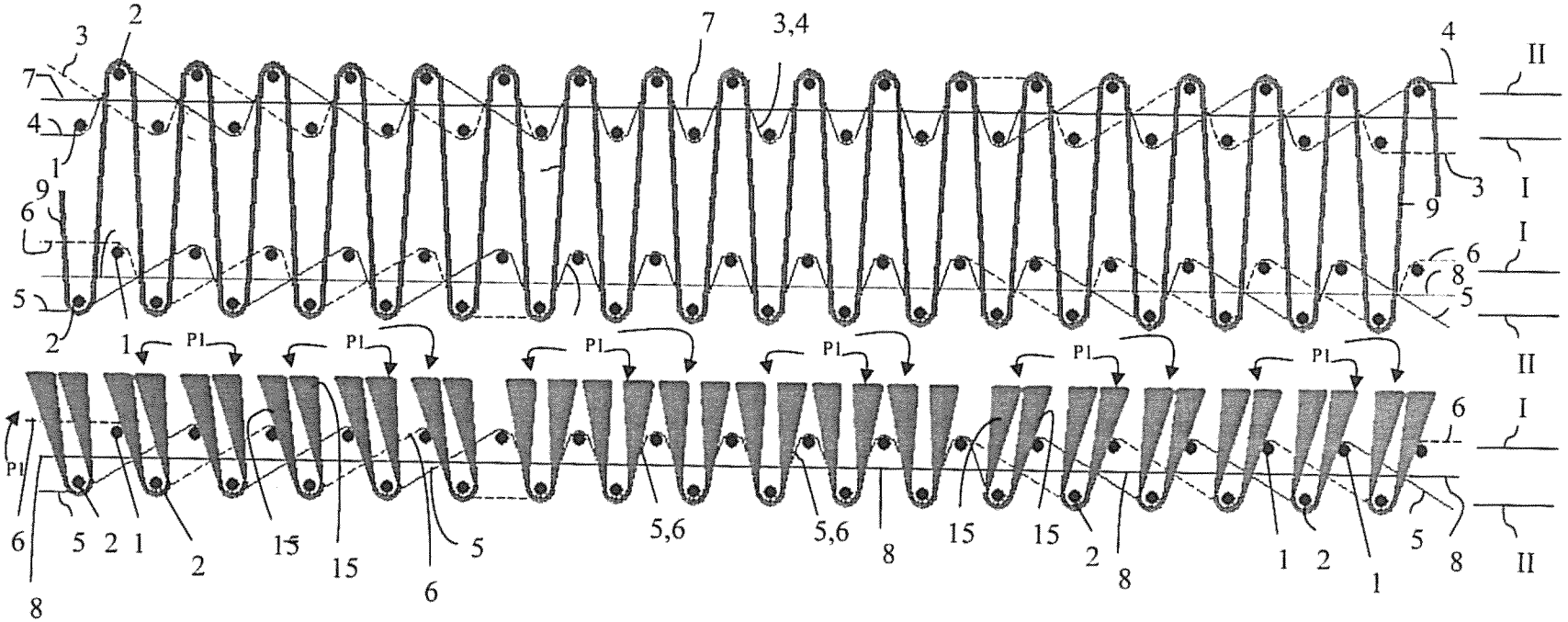
FIG. 2 shows a diagrammatic cross section of a face-to-face fabric which produces two pile fabrics with zones of differently oriented pile; underneath this cross section, the lower pile fabric is shown diagrammatically in cross section.

The face-to-face fabric of FIG. 2 differs from the face-to-face fabric of FIG. 1 in that only one pile warp thread (9) is provided and in that a central zone is also formed in the pile fabrics in which upright pile is formed.

At the bottom of FIG. 2, the lower pile fabric is shown and it can clearly be seen that the pile tufts (P1) in a left-hand zone have pile legs (15) which are oriented obliquely to the left in the warp direction, that the pile tufts (P1−) in a central zone have pile legs (15) which stand virtually upright, and that the pile tufts (P1) in a right-hand zone have pile legs (15) which are oriented obliquely to the right in the warp direction.

The ground weave used is 1/1 for the tension warp threads (7); (8) and 2/2 for the binding warp threads (3),(4); (5),(6) in the zones where pile tufts (P1), (P3) with obliquely oriented pile legs (15) are formed. The pile weave used is a 1/2-V-weave.

In the left-hand zone and the right-hand zone of the pile fabrics, pile tufts with obliquely oriented pile legs are obtained. In successive openings between binding warp threads (3),(4); (5),(6) which cross one another, in each case a first (1) and a second weft thread (2) are bound in. For each opening, a pile tuft is also formed in those zones in each case over one second weft thread (2). In this case, a second weft thread (2) and a first weft thread (2) are successively provided in each opening of the upper base fabric. A second weft thread (1) and a first weft thread (2) are also successively provided in each opening of the lower base fabric. In the right-hand zone, the sequence of first weft threads (1) and second weft threads (2) in each opening is reversed compared to the sequence in the left-hand zone. As a result thereof, the orientation of the pile legs in the left-hand zone is opposite to that of the pile legs in the right-hand zone.

The ground weave used for the binding warp threads is 1/1 in the central zone where pile tufts (P1) with upright pile legs are formed. In this central zone, both binding warp threads (3),(4);(5),(6) which run together are alternately bent over a first weft thread (1) and over a second weft thread (2). In this case, no openings are thus formed between the binding warp threads.

In this zone, the pile-forming pile warp thread (9) forms pile tufts (P1) in both fabrics over a second weft thread (2) which is only bound into the base fabric between the binding warp threads (3),(4);(5),(6) which run together and a tension warp thread (7);(8). In this case, pile tufts with upright pile legs are produced.

Figure 3:
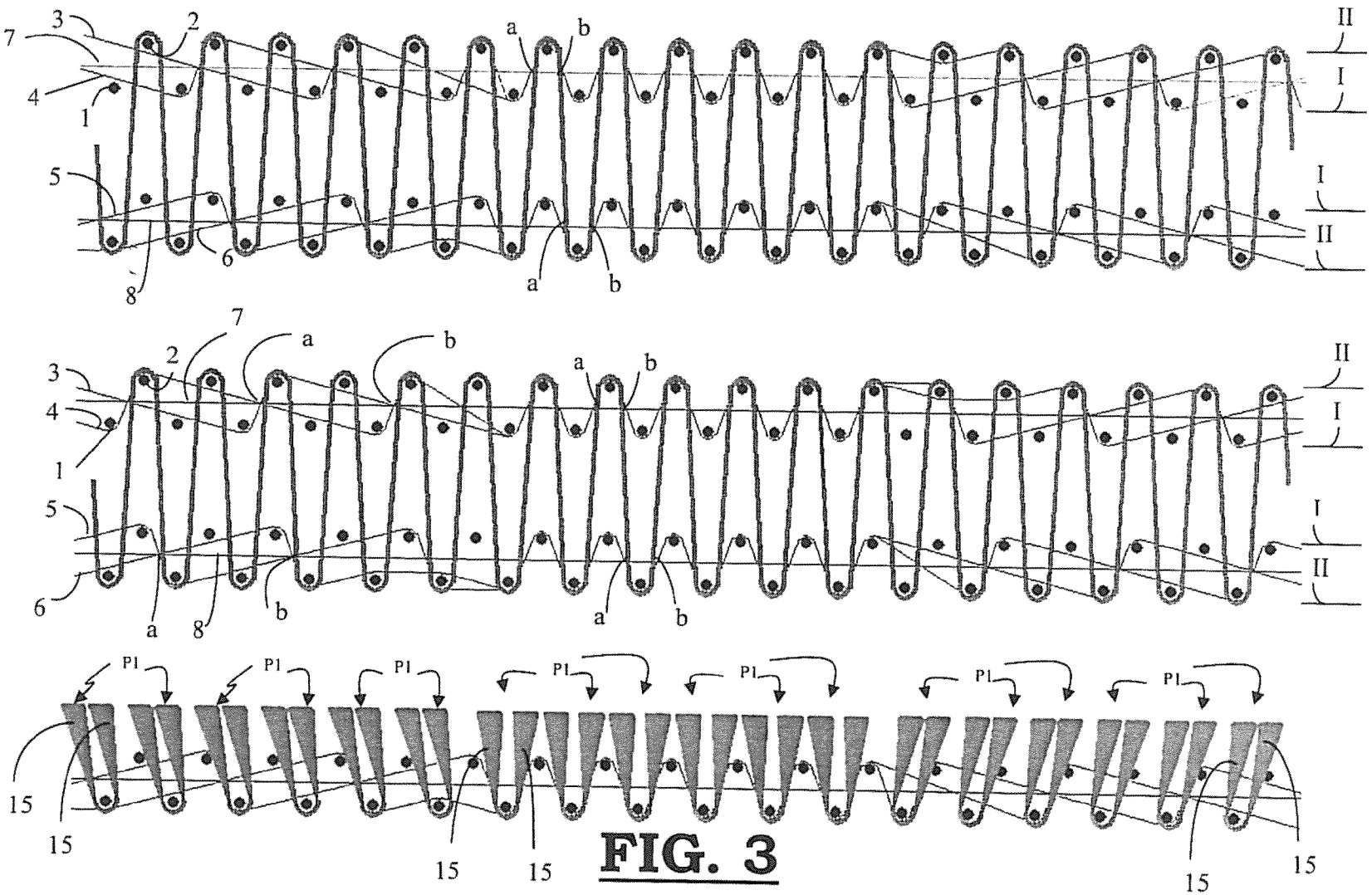
FIG. 3 shows, in two diagrammatic cross sections, warp threads of two adjacent reed dents of a face-to-face fabric which produces two pile fabrics with zones of differently oriented pile; underneath these two cross sections, the lower pile fabric is shown diagrammatically in cross section.

The face-to-face fabric of FIG. 3 also produces two pile fabrics with three zones in which the pile tufts (P1) have differently oriented pile legs. The figure shows two cross sections which illustrate the warp threads of adjacent reed dents. The ground weave for the binding warp threads is 1/1 in the central zone where pile tufts (P1) with upright pile legs are formed (as according to FIGS. 2) and 4/4 offset over 2 dents in the left-hand zone and the right-hand zone where pile tufts (P1) with obliquely oriented pile legs are produced.

Here, the pile weave used is also a 1/2-V-weave, in which pile is formed in each case over a second weft thread (2). In the left-hand zone of both pile fabrics, openings are formed between the binding warp threads (3),(4); (5),(6) in which in each case a second (2) and a first weft thread (1) is successively bound in. In the right-hand zone of both pile fabrics, this sequence is reversed and successively a first (1) and a second weft thread (2) is bound in each opening between binding warp threads (3),(4); (5),(6). As a result thereof, the orientation of the pile legs in the left-hand zone is opposite to that of the pile legs in the right-hand zone.

The ground warp threads of both reed dents which are shown one below the other in FIG. 3 cooperate to produce the entire ground weave. Thus, some weft threads are not bound in by the binding warp threads of the one reed dent, but these weft threads are bound in by the binding warp threads of the adjacent reed dent.

The openings between binding warp threads may be seen as the openings between binding warp threads of each reed dent separately, but they may also be seen as the openings between binding warp threads of adjacent reed dents with cooperating ground warp threads. Both interpretations meet the requirements for obtaining the oblique pile orientation.

If the binding warp threads are considered for each reed dent, the following applies in the left-hand zone of the pile fabrics from FIG. 3 to each pile tuft (both in the upper and in the lower pile fabric):

A1=0, B1=1

A2=0, B2=0

K=K1−K2=0=even

In the right-hand zone of the pile fabrics according to FIG. 3, the following applies to each pile tuft (both in the upper and in the lower pile fabric):

A1=1, B1=0

A2=0, B2=0

K=K1−K2=0=even

This results in slanting pile legs oriented to the left in the left-hand zone and pile legs which are oriented to the right in the right-hand zone. This is clearly illustrated at the bottom of FIG. 3, where the lower pile fabric is shown separately with the pile tufts (P1) with pile legs oriented to the left and the pile tufts (P1) with pile legs oriented to the right.

Figure 4:
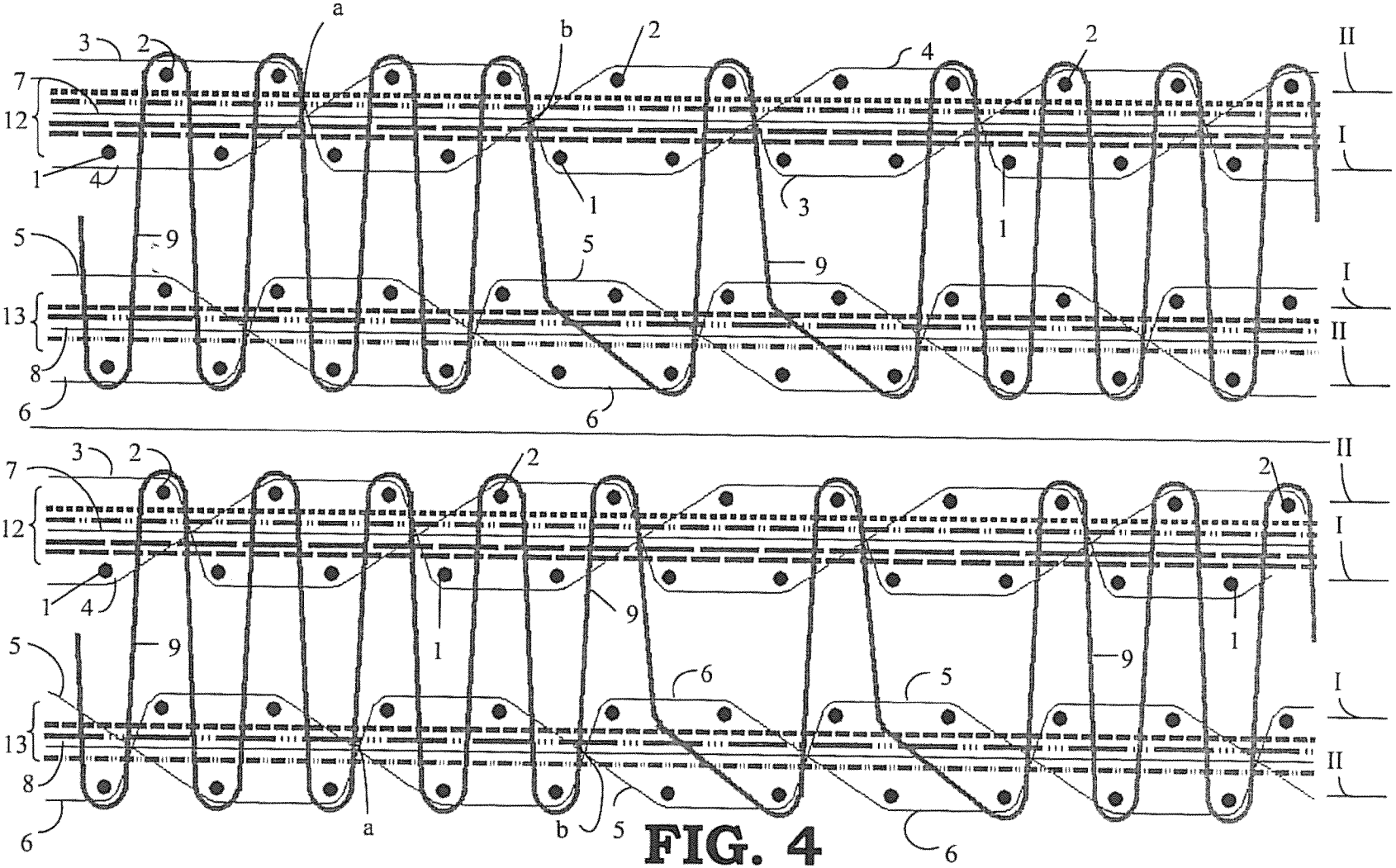
FIG. 4 shows, in two diagrammatic cross sections, the warp threads of two adjacent reed dents of a face-to-face fabric which produces two pile fabrics with zones of different pile density.

When weaving the face-to-face fabric according to FIG. 4, the ground warp threads (3-8) which cooperate to weave the ground weave are distributed over two reed dents. The two cross sections in FIG. 4 show the ground warp threads (3-8) of these two adjacent reed dents. Both reed dents contain a pile-forming pile warp thread (9), a pair of pile warp threads (12) with non-pile-forming parts which are bound into the upper base fabric in an extended state together with the tension warp threads (7), and a pair of pile warp threads (13) with non-pile-forming parts which are bound into the lower base fabric in an extended state together with the tension warp threads (8).

The binding warp threads (3),(4);(5),(6) repeatedly cross each other and form openings between their successive crossings (a), (b). In each opening, in each case two first weft threads (1) and two second weft threads (2) are bound in at different levels (I), (II), in which for each opening a first (1) and a second weft thread (2) are alternately bound in, and in which a start is made on the left-hand side with a first weft thread (1).

In a left-hand zone and a right-hand zone, pile is formed according to a 1/2-V-weave, in which pile is formed for each opening over both second weft threads (2). Thus, two pile tufts are obtained for each opening, referred to below as the left-hand pile tuft and the right-hand pile tuft.

In a central zone, pile is formed according to a 1/4-V-weave, in which pile is only formed over one second weft thread (2) for each opening, so that a lower pile density is obtained in this central zone, this being half of the pile density in the left-hand zone and the right-hand zone.

The ground weave is 1/1 for the tension warp threads and 4/4 offset over two dents for the binding warp threads.

The repeat for the ground warp threads extends over 8 weft introduction cycles. Such a repeat cannot be produced using a traditional cam disc machine anymore, as these are only fitted with cams for a repeat of 4 or 6 weft introduction cycles.

On the one hand, this fabric features the effect of the pile legs which are oriented to the right.

After all, the following applies to each right-hand pile tuft in the openings of the left-hand zone and the right-hand zone:

A1=2, B1=0

A2=1, B2=0

K=K1−K2=2−2=0=even

This results in a slanting position of the pile legs oriented to the right.

The following applies to each left-hand pile tuft in the openings of the left-hand zone and the right-hand zone:

A1=1, B1=1

A2=0, B2=1

K=K1−K2=2−2=0=even

This likewise results in a slanting position of the pile legs oriented to the right.

On the other hand, this fabric also features a second effect, namely the effect of the change in pile density. This second effect is accentuated very clearly as a result of the fact that relatively few crossings (a),(b) are formed between binding warp threads (3), (4); (5), (6), as a result of which four weft threads (1), (2) are bound in relatively closely together for each opening. This is possible because a relatively long ground weave repeat is being used.

As a result of this long weave repeat, the transition between a pile weave according to a 1/2-V-weave and a pile weave according to a 1/4-V-weave can also be achieved in a way which results in a clear variation in the pile density. After all, the long ground weave makes it possible to achieve a higher pile density in the zone with 1/2V weave so that there is a distinct contrast with the 1/4V weave.

The face-to-face fabric from FIG. 5 differs from that in FIG. 4 by the fact that a 2/2 ground weave (instead of a 4/4 ground weave) is used for the binding warp threads (3), (4); (5), (6) in the central zone with lower pile density.

This results in an improved pile strength for the pile tufts in this central zone. The upright position of the pile legs is also improved.

FIGS. 6 to 13 show face-to-face fabrics in which the second weft threads (2)—i.e. the first weft threads (1) which are not situated on the pile side—are distributed over two different levels (II), (III), so that the first (1) and second weft threads (2) together are bound into the base fabrics at a total of three different levels (I), (II), (III).

The first weft threads (1) and the second weft threads (2) of the second level (II) are separated from one another and kept at different levels by the parts of non-pile-forming pile warp threads (12), (13) which have been bound in in an extended state. The second weft threads (2) of the second level (II) and the second weft threads (2) of the third level (III) are separated from each other by tension warp threads (7);(8) and kept at different levels. Of each group of four weft threads in an opening between binding warp threads, two first weft threads (1) are bound in at the first level (I), one second weft thread (2) is bound in at the second level (II), and one second weft thread (2) is bound in at the third level.

Binding in the weft threads (1), (2) at three different levels (I), (II), (III) makes it possible for the successive weft threads to move towards one another in the pile fabric and to achieve higher weft thread densities. As a result thereof, it is also possible to increase the pile density.

The designation 1+1/2V indicates that one weft thread is not inserted for each fabric for every 4 weft introduction cycles in the zone where a 1/2-V-pile weave is used. Analogously, the designation 1+1/4V is used to indicate that one weft thread is omitted in the zone with 1/4-V-pile weave, for each fabric and for every 4 weft introduction cycles.

The pile tufts in these figures are also formed in each case over a second weft thread (2).

The face-to-face fabric from FIG. 6 differs from the face-to-face fabric of FIG. 5 in that a second weft thread (2) is bound in each opening at a third level and in that, in the zone with 1/2-V-pile weave, the pile formation in each case takes place alternately for each dent over a second weft thread (2) of the second level (II) or over a second weft thread (2) of the third level (III).

Pile is thus formed for each opening over two second weft threads (2) which are bound into the relevant base fabric at a different level (II), (III).

The 1/4-V-weave is offset over 2 dents. The ground weave is 3/1 for the tension warp threads (7);(8) and 4/4 for the binding warp threads (3),(4); (5),(6).

FIG. 7 differs from FIG. 6 in that a first weft thread (1) has been omitted in each fabric for each opening. This makes it possible to increase the pile density still further in the zone with 1/2-V-pile weave. By omitting weft threads (1), the designation of the pile weaves becomes 1+1/2V and 1+1/4V (offset over 2 dents) with the associated ground weave being 3/1 for the tension warp threads (7);(8) and 4/4 for the binding warp threads (3),(4); (5),(6).

In FIGS. 7, 9, 11 and 13, the location where a weft thread has been omitted in the fabric is represented symbolically by a small circle. This is indicated by reference numeral (14). In this location, the weft introduction means of the weaving loom will not introduce a weft thread.

Figure 8:
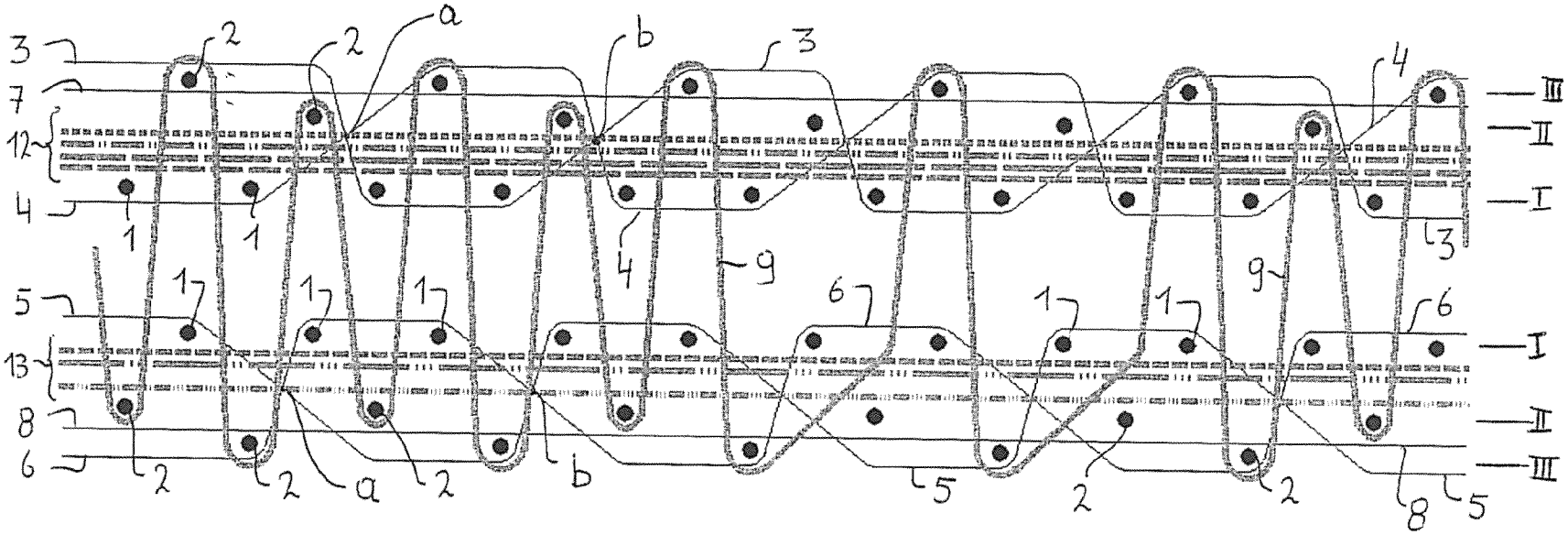
FIGS. 8 and 9 each show a diagrammatic cross section of a face-to-face fabric which produces two pile fabrics with zones of different pile density, in which FIG. 9 only differs from FIG. 8 in that weft threads have been omitted from the face-to-face fabric of FIG. 9.

FIG. 8 shows a face-to-face fabric with a zone of lower pile density between two zones of higher pile density, in which a 1/2-V-pile weave and a 1/4-V-pile weave have been used and in which pile is formed only over second weft threads (2) at the third level (III) in the zone of low pile density. The ground weave is 3/1 for the tension warp threads (7);(8) and 4/4 for the binding warp threads (3),(4); (5),(6).

Figure 9:
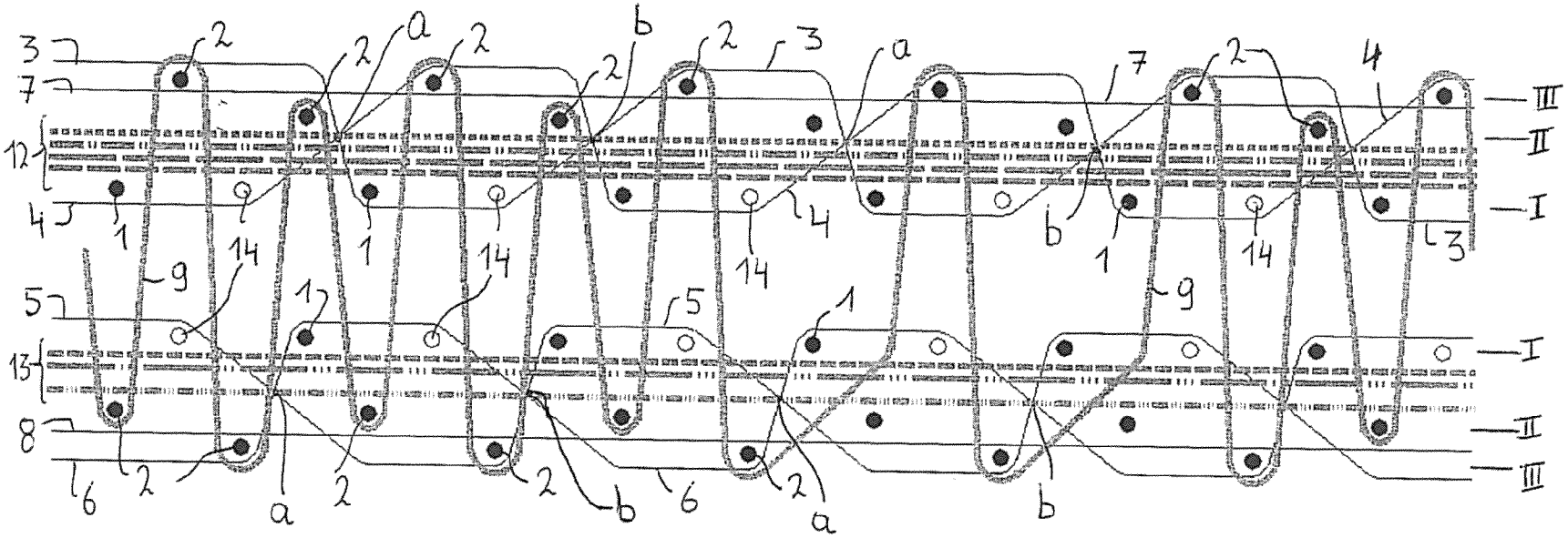

FIG. 9 differs from FIG. 8 in that a first weft thread (1) has been omitted in each fabric for each opening. This makes it possible to increase the pile density still further in the zone with 1/2-V-pile weave. By omitting weft threads (1), the designation of the pile weaves becomes 1+1/2V and 1+1/4V (offset over 2 dents) with the associated ground weave being 3/1 for the tension warp threads (7);(8) and 4/4 for the binding warp threads (3),(4); (5),(6).

FIGS. 10 to 13 relate to face-to-face fabrics in which pile is formed over second weft threads (2) which are separated and kept at a different level (II) by non-pile-forming parts of pile warp threads (12); (13) of the first weft threads (1) which have been bound in in an extended state. The tension warp threads (7);(8) distribute the second weft threads (2) over two different levels (II), (III). The relatively long ground weave repeat over 16 weft introduction cycles makes a still greater weft thread density possible, or makes the introduction of weft threads even easier, so that the pile fabric, in particular a carpet, may be prevented from curling up. The longer the ground weave repeat, the less frequently the binding warp threads can cross, resulting in a higher pile density. In addition, this also results in a reduced consumption of ground warp yarn.

FIG. 10 shows two cross sections which represent the warp threads of adjacent reed dents. The ground warp yarns of both reed dents cooperate in order to bind the weft threads into both base fabrics.

In the face-to-face fabrics which are shown in FIGS. 10 and 11, the bound-in non-pile-forming parts of the pile warp threads (12); (13)—also referred to as the dead pile—ensure that the first weft threads (1) are separated from the second weft threads (2) and kept at different levels. The only function of the tension warp threads (7); (8) here is to distribute the second weft threads (2) over two levels (II), (III).

In this case, it is the binding warp threads (3),(4); (5),(6) which bind the weft threads (1), (2) in successive openings between their crossings (a), (b). When determining the openings between ground warp threads (in the sense of the present invention), only the crossings between the binding warp threads (3),(4); (5),(6) have to be taken into account and crossings between a binding warp thread (3),(4); (5),(6) and a tension warp thread (7);(8) thus do not have to be taken into account.

By using a 1/2-V-pile weave in a left-hand zone and a right-hand zone and a 1/4-V-pile weave (offset over two dents) in a central zone, a variation in the pile density in both pile fabrics is produced. The associated ground weave has a repeat which extends over 16 weft introduction cycles and which is also offset over 2 dents.

FIG. 11 differs from FIG. 10 in that a first weft thread (1) has been omitted in each fabric for each opening. This makes it possible to increase the pile density still further in the zone with 1/2-V-pile weave. By omitting weft threads (1), the designation of the pile weaves becomes 1+1/2V and 1+1/4V (offset over 2 dents). The associated ground weave has a repeat which extends over 16 weft introduction cycles.

FIG. 12 shows a face-to-face fabric as illustrated in FIG. 10, which shows two cross sections of the warp threads of adjacent reed dents. The ground warp yarns of both reed dents cooperate in order to bind the weft threads into both base fabrics.

In the fabric in FIG. 12, pile is only formed in the zone of low pile density over second weft threads (2) at the third level (III). The associated ground weave has a repeat which extends over 16 weft introduction cycles (offset over two dents).

FIG. 13 differs from FIG. 12 in that a first weft thread (1) has been omitted in each fabric for each opening. This makes it possible to increase the pile density still further in the zone with 1/2-V-pile weave. By omitting weft threads (1), the designation of the pile weaves becomes 1+1/2V and 1+1/4V. The associated ground weave has a repeat which extends over 16 weft introduction cycles (offset over two dents).

The weaves according to this method can be included in the pattern of the jacquard design. They may also be in a separate pattern which only actuates the weaving frames. The input of data can take place via the weaving loom 'user interface' or via a separate 'design editor', in which the desired weaving pattern is converted into a file which contains the required information for actuating the various components of the weaving loom.

The invention claimed is:

1. Method for weaving a pile fabric on a weaving loom, comprising:

introducing weft threads between a number of ground warp threads which have been provided in reed dents of the weaving loom, in successive weft introduction cycles, thereby weaving at least one base fabric having first weft threads bound in on a first level situated on the pile side of the fabric and second weft threads bound in on a level which is situated on the rear side relative to the first level, and having pile warp threads that form pile tufts over respective second weft threads, determining successive positions of the ground warp threads relative to the weft threads according to a ground weave repeat which extends over at least eight weft introduction cycles, wherein introducing weft threads between a number of ground warp threads comprises binding in groups of at least one weft thread in openings between a pair of binding warp threads of the same reed dent or of adjacent reed dents, between a first and a second crossing between said binding warp threads, wherein at least one pile tuft is formed over at least one second weft thread of each group, and wherein the following applies to each pile tuft:

$A_1$=the number of first weft threads between the first crossing and the pile tuft, $A_2$=the number of second weft threads between the first crossing and the pile tuft, $B_1$=the number of first weft threads between the pile tuft and the second crossing, $B_2$=the number of second weft threads between the pile tuft and the second crossing, K1=the total number of first weft threads between the first and the second crossing and K2=the total number of second weft threads between the first and the second crossing, K=K1−K2, and each of said numbers of $(A_1)$,$(A_2)$,$(B_1)$, $(B_2)$ is zero or nonzero, wherein determining said successive positions of the ground warp threads with respect to the weft threads comprises determining successive positions such that at least two orientations of a first (i), a second (ii) and a third orientation (iii) of the pile tuft legs are created within the same ground weave repeat, wherein oblique orientations (i), (ii) of the pile tuft legs are obtained when at least one first weft thread and at least one second weft thread are provided for each group, in which i. the first orientation (i) is an oblique orientation which is obtained if $A_1+B_2$ is greater than $A_2+B_1$, or $B_1=0$ while $A_1\neq 0$, if K is an odd number;

ii. the second orientation (ii) is a differently directed oblique orientation which is obtained if $A_1+B_2$ is smaller than $A_2+B_1$, or $A_1=0$ while $B_1\neq 0$, if K is an odd number;

iii. the third orientation (iii) is a substantially vertical orientation which is obtained if $A_1+B_2$ is equal to $A_2+B_1$.

2. Method for weaving a pile fabric on a weaving loom according to claim 1, characterized in that the weft threads are bound into each base fabric on at least three different levels.

3. Method for weaving a pile fabric on a weaving loom according to claim 1, characterized in that the ground warp threads of each reed dent or of two or more adjacent reed dents comprise at least one binding warp thread and at least one tension warp thread for each base fabric, in that said openings in each base fabric are formed between two crossing binding warp threads, and in that the first and second weft threads in each base fabric are separated from each other by a tension warp thread so that they are bound in at two different levels.

4. Method for weaving a pile fabric on a weaving loom according to claim 1, characterized in that the ground warp threads of each reed dent or of two or more adjacent reed dents for each base fabric comprise a first and a second tension warp thread, so that the first weft threads are bound in on the pile side relative to the first tension warp threads, a first part of the second weft threads is bound in between the first and the second tension warp threads, and a second part of the second tension warp threads is bound in on the rear side of the second tension warp thread, so that the second weft threads are distributed over two different levels.

5. Method for weaving a pile fabric on a weaving loom according to claim 1, characterized in that a face-to-face weaving method is used, in which two base fabrics are woven simultaneously, one above the other, in which pile warp threads are alternately bound in over a second weft thread of the upper base fabric and a second weft thread of the lower base fabric, and in which the pile warp threads between both base fabrics are cut so that two pile fabrics with pile tufts are obtained.

6. Method for weaving a pile fabric according to claim 1 characterized in that non-pile-forming parts of pile warp threads are bound into a base fabric or into one of both base fabrics in an extended state.

7. Method for weaving of a pile fabric according to claim 5, characterized in that the first and second weft threads are separated from each other by the non-pile-forming parts of pile warp threads which have been bound in in an extended state, so that said weft threads are bound in at two different levels.

8. Method for weaving a pile fabric according to claim 1, characterized in that the pile warp threads form pile according to a ½-V-weave.

9. Method for weaving a pile fabric according to claim 1, characterized in that the pile fabric is woven on an Axminster weaving loom.

10. Method for weaving of a pile fabric according to claim 1, characterized in that, within the same ground weave repeat, first and second openings are formed in which second weft threads are bound in over which pile is formed at a different pile density.

11. Method for weaving a pile fabric according to claim 10, characterized in that the positions of the ground warp threads relative to the weft threads are determined in such a manner that a larger number of weft threads are bound in the first openings than in the second openings, and in that pile is formed at a higher pile density over the weft threads of the first openings than over the weft threads of the second openings.

12. Method for weaving a pile fabric on a weaving loom according to claim 11, characterized in that no weft thread is introduced by a weft introduction means of the weaving loom during a number of weft introduction cycles, resulting in at least one first weft thread being omitted in the first openings.

13. Method for weaving a pile fabric on a weaving loom according to claim 10, characterized in that, within the same ground weave repeat, first openings are formed with second weft threads over which pile is formed according to a 1/2-V-weave, and second openings are formed with second weft threads over which pile is formed according to a 1/4-V-weave.

* * * * *